US009308978B2

(12) United States Patent
Ulgen

(10) Patent No.: US 9,308,978 B2
(45) Date of Patent: Apr. 12, 2016

(54) MARINE PROPELLER HAVING DEMOUNTABLE BLADES

(76) Inventor: Mehmet Nevres Ulgen, Istanbul (TR)

( * ) Notice: Subject to any disclaimer, the term of this patent is extended or adjusted under 35 U.S.C. 154(b) by 737 days.

(21) Appl. No.: 13/616,215

(22) Filed: Sep. 14, 2012

(65) Prior Publication Data

US 2014/0079553 A1 Mar. 20, 2014

(51) Int. Cl.
*B63H 1/20* (2006.01)

(52) U.S. Cl.
CPC ..... *B63H 1/20* (2013.01)

(58) Field of Classification Search
CPC ..... B63H 1/14; B63H 1/20; F04D 29/34; F04D 29/322; F04D 29/329
USPC ..... 416/244 B
See application file for complete search history.

(56) References Cited

U.S. PATENT DOCUMENTS 390,615 A * 10/1888 Nye ..... 416/220 R
1,122,925 A 12/1914 Henricksen
1,514,246 A * 11/1924 Assala ..... 416/220 R
2,155,611 A * 4/1939 Meyerhoefer ..... 416/219 R
3,132,698 A * 5/1964 Lesher ..... 416/220 R
3,764,228 A 10/1973 Shook
4,150,921 A 4/1979 Wennberg et al.
4,930,987 A 6/1990 Stahl
7,357,686 B2 * 4/2008 Lin et al. ..... 440/50

FOREIGN PATENT DOCUMENTS

DE 160524 10/1917
EP 0894708 A2 2/1999
FR 2184660 A1 12/1973

* cited by examiner

*Primary Examiner* — Craig Kim
*Assistant Examiner* — Adam W Brown
(74) *Attorney, Agent, or Firm* — Vidas, Arrett & Steinkraus, P.A.

(57) ABSTRACT

A vessel propeller comprising a cylindrical hub rotatable about a rotation axis and a plurality of blades provided radially around the hub with a certain pitch angle. The propeller is characterized in that the hub comprises a blade connection housing helically formed on the cylindrical surface of the hub for the demountable connection of each blade to the hub; each blade comprises a hub connector to be placed in the respective connection housing; and plurality of external connecting members extending axially along the hub thickness for rigidly connecting the hub and plurality of blades.

9 Claims, 4 Drawing Sheets

MARINE PROPELLER HAVING DEMOUNTABLE BLADES

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to a vessel propeller having demountable blades.

The propulsion required for the movement of marine vessels sailing afloat such as boats, ships and under water such as submarines is provided by propellers. Propellers, in general, consist of a central hub and plurality of blades combined with the hub. The surfaces of the propeller blades are generally helicoidal and the flowing water is caught by the leading edge of the blade and compressed on the helicoidal surface to form a pressure and then it accelerates over the blade and leaves from the trailing edge. The course of the fluid on blade surface, and hence the water compression on blade surface affect the amount of thrust to be obtained.

Propellers are conventionally cast in one piece and produced after being machined. In other words, the blades are integrally produced with the hub. This structure has some disadvantages: For example, blades, in general, are not allowed to overlap for the removal of the propellers from the cast mold, and for the surface machining after molding; and therefore such blades can get slightly higher than surface area ratio 1:1, generally being under value of 1 (e.g. 0.950). Another disadvantage of the known propellers is that in case one of the blades is damaged due to mechanical fatigue, external impacts, or some other reasons, the entire propeller needs to be replaced. Moreover, blades must be provided along hub thickness (i.e. along the axis of the hub) in order to obtain maximum thrust from the blades arranged radially around the hub. Production cost of such a complicated structure is high, since a detailed planning before and during operation is required; moreover, huge benches or machine tracks are needed so as to meet the size of the entire propeller.

U.S. Pat. No. 4,930,987, the entire contents of which is incorporated herein by reference, discloses a propeller with demountable blades. The blades are in fact integrally connected to the hub having a dismountable structure each piece of which is integrated with a blade. The disadvantage of the propeller disclosed in U.S. Pat. No. 4,930,987 is that, when one of the blades is to be replaced, the hub needs to be replaced partially, as well. Thus, this necessity leads to the loss of hub material, apart from blade material.

U.S. Pat. No. 3,764,228, the entire contents of which is incorporated herein by reference, discloses a propeller with replaceable blades. The hub is disintegrated and each blade is integrated to these hub parts. In other words, as in U.S. Pat. No. 4,930,987, when one of the blades is to be replaced, the hub needs to be replaced partially as well.

U.S. Pat. No. 1,122,925, the entire contents of which is incorporated herein by reference, has a similar disadvantage. The blades are integrated into the parts of the hub. Moreover, none of the above mentioned prior art references provides an adequately rigid blade-hub connection. Possible consequences of this disadvantage include increased propeller vibration, occurring unbalanced centrifugal forces, noisy operation of the propeller, leading to reduced propeller efficiency.

BRIEF SUMMARY OF THE INVENTION

An object of the present invention is to provide a propeller having demountable blades, with an increased connection rigidity and efficiency.

The present invention relates to a vessel propeller comprising a cylindrical hub rotatable about a rotation axis and a plurality of blades provided radially around the hub with a certain pitch angle. The propeller is characterized in that the hub comprises a blade connection housing helically formed on the cylindrical surface of the hub for the demountable connection of each blade to the hub; each blade comprises a hub connector to be placed in the respective connection housing; and plurality of external connecting members extending axially along the hub thickness for rigidly connecting the hub and plurality of blades.

Thus, it is possible to have a propeller, whose blades can be rigidly connected to the hub in a demountable manner, without the need for disintegrating the hub.

The connection of blades to the hub is preferably achieved by means of bolts or nuts. Therefore, holes formed axially along the hub thickness around rotation axis of the hub are provided in order for the bolts to pass there through. Similarly, hub connectors are provided with holes in order for the bolts to pass there through.

In a preferred embodiment of the invention, the curve of the blade connection housings formed helically on the external cylindrical surface of the hub is formed such that the same connecting member can be used for connecting two consecutive blades to the hub, when it is passed axially through the hub. However, in any case, it is preferable that a blade is connected to the hub by means of multiple connecting members.

BRIEF DESCRIPTION OF THE SEVERAL VIEWS OF THE DRAWINGS

In order for the embodiment and advantages thereof, together with the additional elements to be better understood, the following figures should be taken into account while evaluating.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
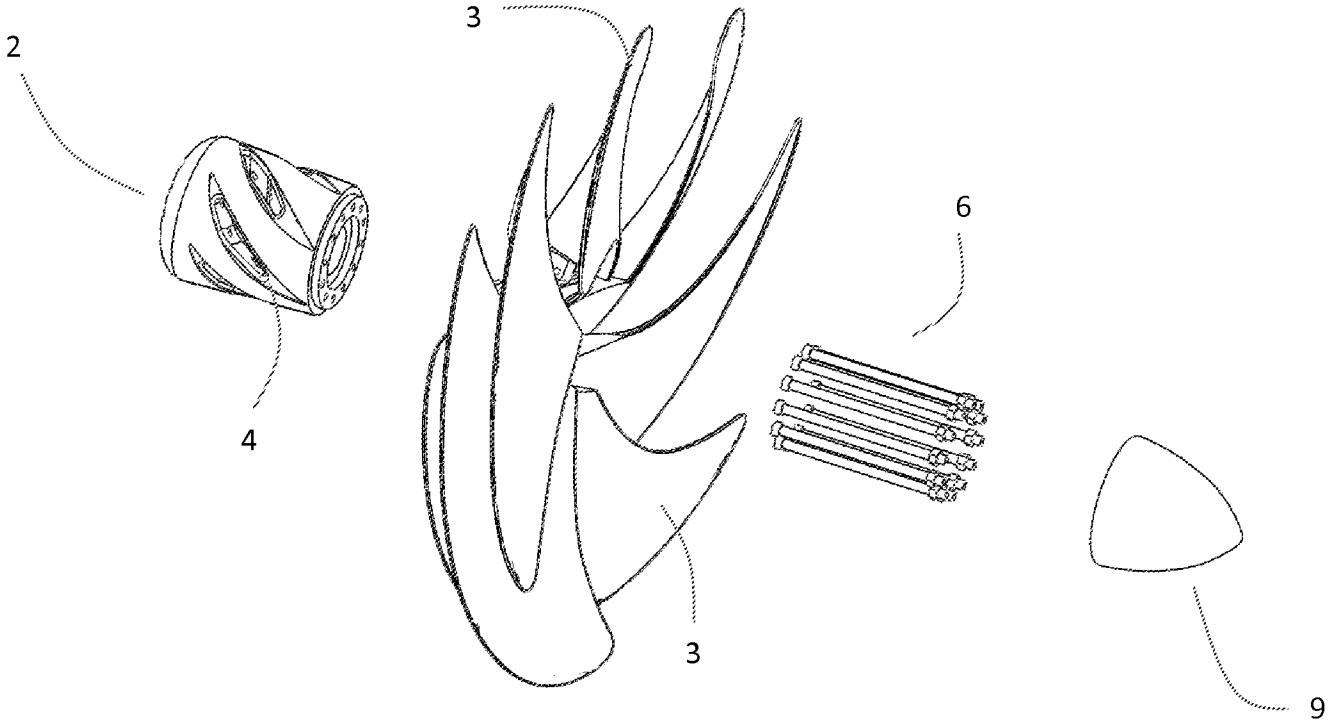
FIG. 1 is an exploded view of the propeller according to the invention.
Figure 2:
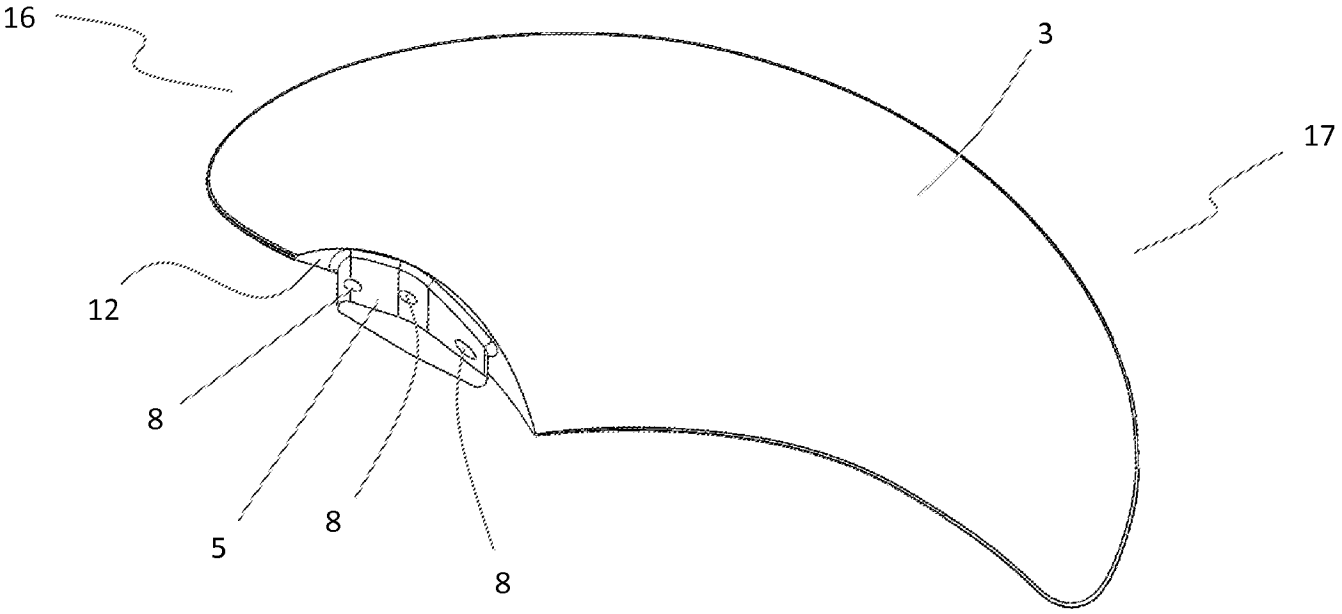
FIG. 2 is a bottom perspective view of a propeller blade of the invention.

As seen in FIG. 1, the propeller (1) according to the invention comprises a hub (2) having a cylindrical form and rotatable around a rotation axis by means of a shaft (not shown) coupled to an engine (not shown); and blades (3) arranged radially around the said hub (2) with a certain pitch angle. In the middle of the hub (2) there is provided a shaft fitting cavity (10), into which the shaft mounted. Each blade (3) is rigidly connected to the hub (2) in a demountable manner by means of connecting members (6). Therefore, a plurality of longitudinal blade connection housings (4) are formed on external cylindrical surface of the hub (2), in the same number as that of blades (3). As can be seen in figures, blade connection housings (4) are arranged along the longitudinal direction of the hub (2) from one end to another, and on the external surface of the hub (2) in helix form. In this case, each blade connection housing (4) extends such that it will make a helix angle (14) with respect to the longitudinal direction of the hub (2).

Each blade (3) comprises a hub connector (5) mounted to the respective blade connection housing (4). The hub connectors (5) are arranged at the edge (12) of the blade (3) connecting with the hub (2). The hub connectors (5) are structured in protrusion form in proximity of the leading edge (16) of the blade (3), preferably right underside of it. The hub connector (5) can be produced together with the blade (3), i.e. in one piece; alternatively, it can be produced individually and fixed to joining edge (12) of blade (3) with the hub (2) by welding, for example. The geometric form of the blade connection housings (4) provides a perfect match with the external geometric form of the hub connectors (5); thus, the outer form of the hub connectors (5) perfectly fits in the inner form of the blade connection housings (4). When a blade connector (5) is fitted in the blade connection housing (4) provided in the hub (2), joining edge (12) of blade (3) with the hub (2) provided on the hub connector (5) perfectly fits on joining surfaces (13) of hub (2) with the blade (3) surrounding blade connection housings (4). These joining surfaces (13) of hub (2) with the blade (3) are formed such that a slight recess is formed on the external cylindrical surface of the hub (2).

Each hub connector (5) comprises a plurality of connecting member openings (8) provided along the width of the respective hub connector (5), the connecting member openings (8) being away from one another. These connecting member openings (8) extend parallel to the longitudinal axis of the hub (2). According to the preferred embodiment of the invention, the number of connecting member openings (8) of each hub connector (5) is three; and these are provided along the longitudinal direction of the hub connectors (5), one in front, another in the middle, and the other in the rear part.

Figure 3:
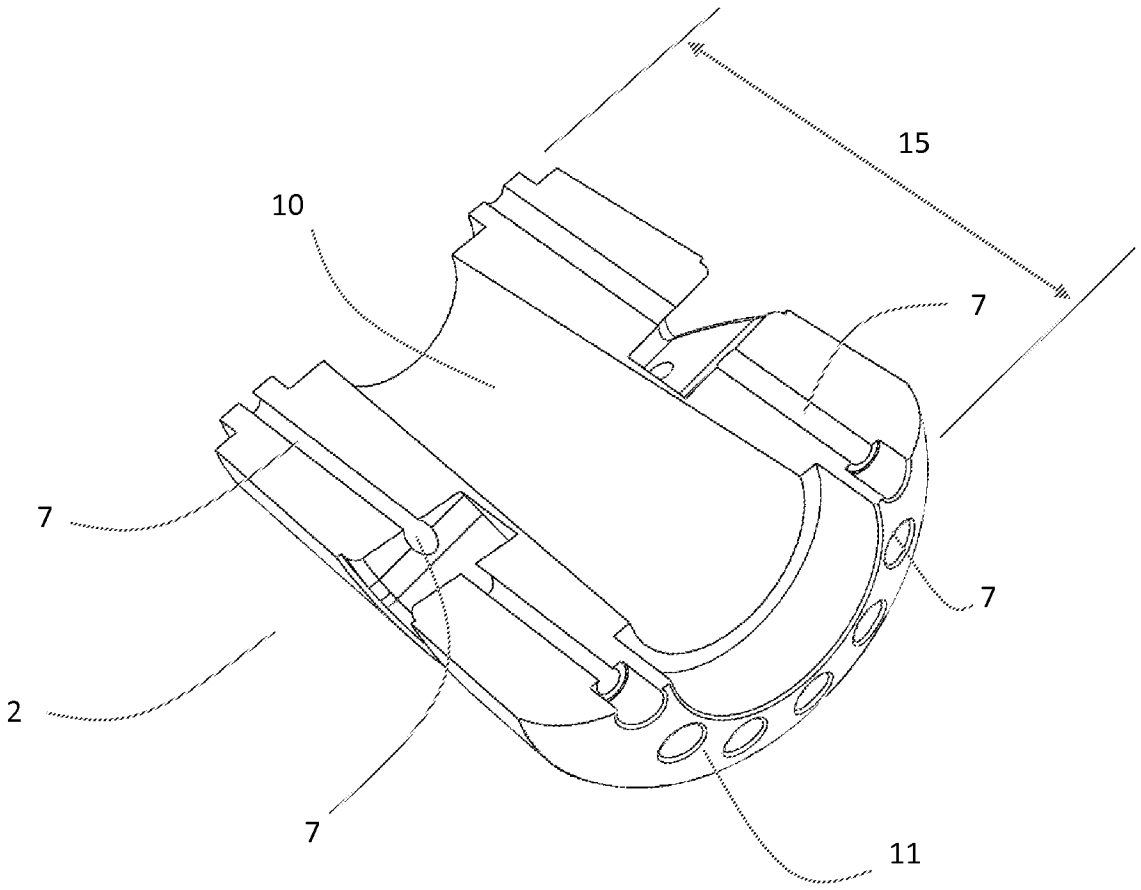
FIG. 3 is a longitudinal sectional view of the propeller hub.

As can be seen in FIG. 3, connecting member holes (7), which are circularly arranged around hub rotation axis and which extend along hub thickness (15) in the inner wall of the hub (2) are provided. The continuity of connecting member holes (7) along hub thickness (15) is interrupted by the blade connection housings (4). That is, the longitudinal axis of the connecting member holes (7) passes through the blade connection housings (4). The distance of connecting member holes (7) from the axis of the hub (2) and their radial locations with respect to the hub axis are arranged such that each connecting member opening (8) fits in the corresponding connecting member hole (7) in the blade connection housing (4), when connectors (5) are fitted in the blade connection housings (4) in the hub (2).

Since the connecting member hole (7) and connecting member openings (8) overlap after hub connectors (5) are fitted in the blade connection housings (4) in the hub (2), the connecting members (6) are passed through the connecting member hole (7) on the frontal surface (11) of the hub (2), and the connecting members (6) are made to pass out of the hole (7) on the other surface (11) of the hub (2), also the connecting members (6) are mechanically fastened in a rigid manner. Thus, the connection of each blade (3) to the hub (2) is provided in a demountable manner.

Advantageously, each connecting member (6) contributes to the fastening of more than one blade (3) to the hub (2). As the blade connection housings (4) are helically opened on the outer surface of the hub (2), consecutive blade connection housings (4) at least partially overlap along the axial direction. In particular, at least one connecting member hole (7) of the consecutive blade connection housings (4) is co-axially provided in the same direction.

Figure 4:
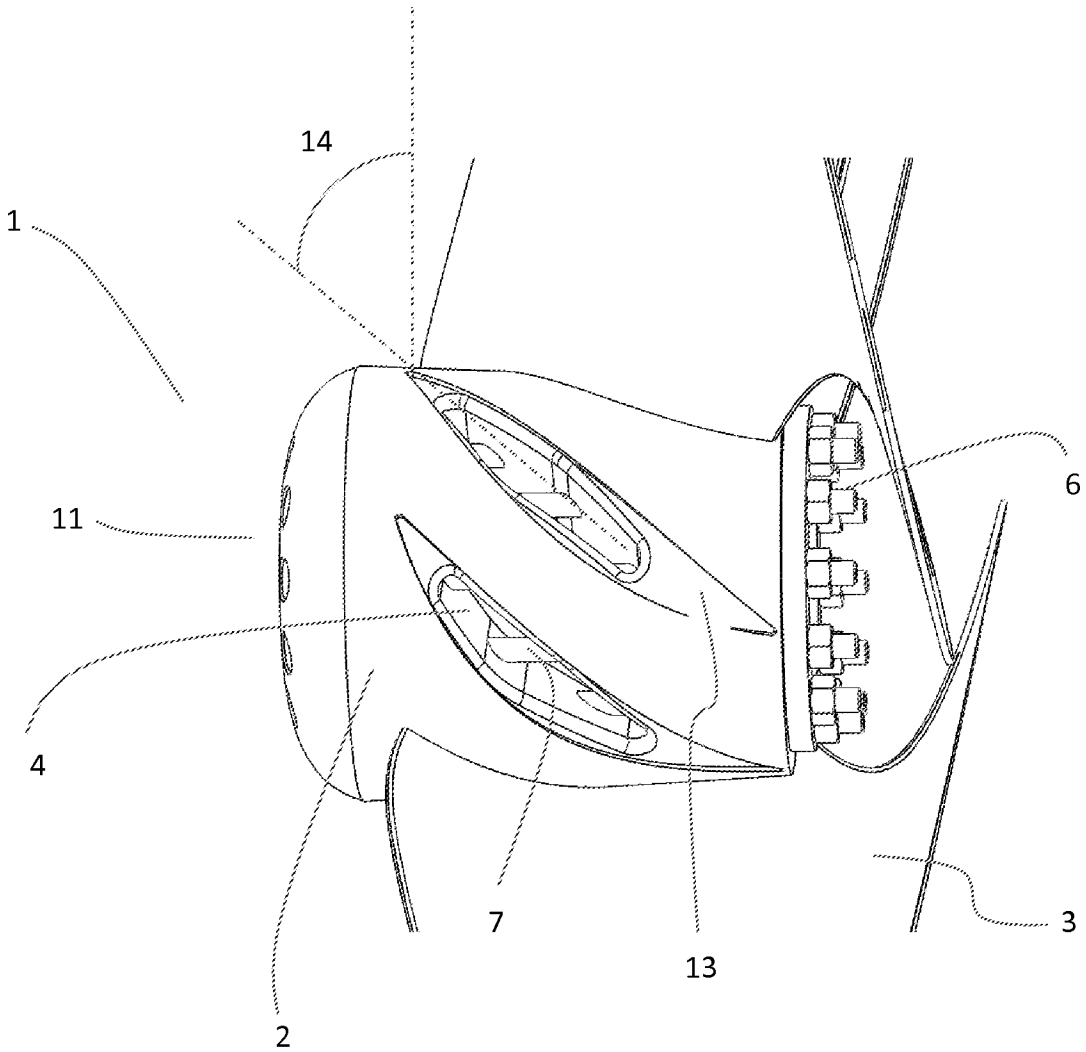
FIG. 4 is a side view of the propeller hub.

Thus, a connecting member (6) used for fastening a blade (3) in a blade connection housing (4) is also used for fastening another blade (3) to the hub (2) in a subsequent blade connection housing (4). In particular, advantageously, as seen in FIG. 4, that the same connecting member (6) passes through the connecting member hole (7) in front part of a blade connection housing (4) and through the connecting member hole (7) in the rear part of a subsequent blade connection housing (4) increases the rigidity of blade-hub connection. In such a case, the connecting member (6) providing the fastening of the blade (3) by passing through the hole in front part of the housing supports the leading edge (16) of the respective blade (3) whereas the connecting member (6) providing the fastening of the blade (3) by passing through the hole at the rear part of the blade connection housing supports the trailing edge (17) of the respective blade (3). As a matter of fact the water entering into and getting out of the blade (3) creates a moment, thereby forming an associated force in blade-hub connection sections (in front and rear parts of the blade connection housings).

According to the preferred embodiment of the invention, the connecting member (6) used for connecting the blades (3) to the hub (2) is a bolt (with a cylindrical straight body and with screw and nut at its end), and the mechanical rigidity of the said bolt connection is provided by a corresponding nut. Some other external connecting member known in the art can be used instead of bolt, e.g. a stud, drift pin etc. After the bolts are inserted, a hub housing (9) is engaged to the frontal surface of the propeller (1) facing the water in a way that it will cover the diameter of the hub (2).

This completes the description of the preferred and alternate embodiments of the invention. Those skilled in the art may recognize other equivalents to the specific embodiment described herein which equivalents are intended to be encompassed by the claims attached hereto.

What is claimed is:

1. A vessel propeller (1) comprising:

a cylindrical hub (2) rotatable about a rotation axis and a plurality of blades (3) provided radially around the cylindrical hub (2) with a certain pitch angle, wherein the cylindrical hub (2) comprises a plurality of blade connection housings (4) helically formed inside the cylindrical surface of the cylindrical hub for the demountable connection of each of the plurality of blades (3) to the cylindrical hub (2); the cylindrical hub (2) comprises connecting member holes (7) arranged around the cylindrical hub rotation axis and extending along the cylindrical hub in an inner wall of the cylindrical hub;

each of the plurality of blades (3) includes a hub connector (5) having a plurality of connecting member openings (8) configured to be placed in each of the plurality of blade connection housings (4); and each hub connector (5) being positioned in its respective connection housing (4) and a plurality of connecting members (6) each extending axially along the respective connecting member hole (7) and connecting member opening (8) for rigidly connecting the cylindrical hub (2) and plurality of blades (3).

2. The vessel propeller according to claim 1, wherein the axial continuity of the connecting member holes (7) is interrupted by the plurality of blade connection housings (4).

3. The vessel propeller according to claim 2, wherein at least one connecting member hole (7) of an adjacent blade connection housing (4) is co-axially provided in the same direction.

4. The propeller according to claim 1, wherein the plurality of connecting member openings (8) are spaced away from one another such that each corresponds to a connecting member hole (7) when the hub connector (5) is placed in the corresponding blade connection housing (4).

5. The vessel propeller according to claim 1, wherein the plurality of connecting members (6) are bolts or drift pins.

6. The vessel propeller according to claim 5, wherein each of the plurality of connecting members (6) includes a nut in order to be mechanically fixed in a rigid manner.

7. The vessel propeller according to claim 1, wherein the geometric form of the plurality of blade connection housings (4) is designed to match the external geometric form of the hub connectors (5).

8. The vessel propeller according to claim 1, wherein each blade (3) includes a joining edge (12) on which a respective hub connector (5) is provided.

9. The vessel propeller according to claim 1, wherein the cylindrical hub (2) includes joining surfaces (13) configured by forming a recess on the external cylindrical surface of the cylindrical hub (2), the joining surfaces (13) surrounding the plurality of blade connection housings (4); wherein each blade (3) includes a joining edge (12), said joining edges (12) of the plurality of blades (3) fit on joining surfaces (13) of the cylindrical hub (2).

* * * * *